US007097480B2

(12) United States Patent
Fukuzaki et al.

(10) Patent No.: US 7,097,480 B2
(45) Date of Patent: Aug. 29, 2006

(54) COAXIAL CONNECTOR WITH A SUBSTANTIALLY S-SHAPED SWITCH

(75) Inventors: Hiroshi Fukuzaki, Yokohama (JP); Yoichi Kasamaru, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/823,569

(22) Filed: Apr. 14, 2004

(65) Prior Publication Data

US 2004/0206614 A1 Oct. 21, 2004

(30) Foreign Application Priority Data

Apr. 15, 2003 (JP) ..... 2003-110735

(51) Int. Cl.
*H01R 29/00* (2006.01)

(52) U.S. Cl. ..... 439/188; 439/189; 439/944

(58) Field of Classification Search ..... 439/188, 439/189, 944; 200/51.1, 51.12
See application file for complete search history.

(56) References Cited

U.S. PATENT DOCUMENTS

| | | | | |
|---|---|---|---|---|
| 5,741,146 | A * | 4/1998 | Henry et al. | 439/188 |
| 6,447,318 | B1 | 9/2002 | Okamoto | |
| 2001/0005645 | A1 | 6/2001 | Zech et al. | |
| 2002/0025707 | A1 | 2/2002 | Hida | |
| 2002/0090863 | A1 | 7/2002 | Baumgaertner et al. | |
| 2002/0160641 | A1* | 10/2002 | Okamoto | 439/266 |
| 2004/0180559 | A1* | 9/2004 | Harasawa | 439/17 |

FOREIGN PATENT DOCUMENTS

| | | | |
|---|---|---|---|
| CN | 1304190 | A | 7/2001 |
| EP | 1 047 159 | A2 | 10/2000 |
| GB | 2 223 134 | A | 3/1990 |
| JP | 2889562 | B1 | 5/1999 |
| KR | 10-2002-0017945 | | 3/2006 |

OTHER PUBLICATIONS

European Search Report, mailed Jul. 23, 2004.
Korean Office Action dated Mar. 24, 2006 corresponding to Korean Patent Application No.:10-2004-0025026.

* cited by examiner

*Primary Examiner*—Chandrika Prasad
(74) *Attorney, Agent, or Firm*—Rader, Fishman & Grauer PLLC

(57) ABSTRACT

A connector with a switch comprises a housing for defining a terminal accommodation chamber opened through a plug pin insertion hole. A fixed terminal and a switch terminal are held by the housing. The switch terminal comprises a U-shaped section opened toward the plug pin insertion hole in the terminal accommodation chamber. The U-shaped section is elastically deformable in a direction crossing the direction of plug pin insertion. The switch terminal is switched from a state in which it is brought into contact with the fixed terminal to a state in which the contact thereof with the fixed terminal is cut off as the U-shaped section is deformed in the direction crossing the direction of plug pin insertion.

15 Claims, 8 Drawing Sheets

COAXIAL CONNECTOR WITH A SUBSTANTIALLY S-SHAPED SWITCH

BACKGROUND OF THE INVENTION

1. Field of the Invention

The present invention relates to a coaxial connector with a switch which is connected to a transmission/receiving circuit in a radio terminal such as a cellular phone, a PHS (Personal Handyphone System), a radio LAN (Local Area Network) module, or an ETC (Electronic Toll Collection) module, and relates to the structure of a coaxial connector with a switch in which a connection of a switch terminal is switched from a fixed terminal to a plug pin by connection to a plug pin in a counterpart connector.

2. Description of Related Arts

Although a coaxial connector with a switch of this type generally connects a built-in transmission/receiving circuit and an attached antenna in a cellular phone, a PHS, or the like, for example, the connection between the built-in transmission/receiving circuit and the attached antenna is interrupted at the time of final examination before shipment to connect the built-in transmission/receiving circuit to an examination device.

Consequently, the coaxial connector of this type may be used for small-sized electronic apparatuses such as a cellular phone in many cases. In order to miniaturize the whole apparatus, it is desired that the coaxial connector is made as small and thin as possible (for example, the height of the connector is set to not more than 2.5 mm or not more than 2 mm).

Conventionally, a technique for providing a fixed terminal 94 extending in a direction 93 perpendicular to a direction of insertion 92 of a plug pin 91 and a switch terminal 95 for switching, which is elastically deformable in an S like shape, and bending the switch terminal 95 pressed by the plug pin 91 such that the S like shape thereof becomes flat to interrupt the connection between the switch terminal 95 and the fixed terminal 94 has been proposed, as shown in FIG. 12 (for example, Japanese Examined Patent Publication No. 2889562 issued on May 10, 1999).

In the above-mentioned gazette, however, the S like shape switch terminal 95 is flattened and bent in the direction of insertion 92 of the plug pin 91. When the elastic range of the switch terminal 95 is considered, therefore, the height of the coaxial connector cannot be made so small. That is, the coaxial connector cannot be thinned.

Further, in a case where the plug pin 91 is too deeply pressed or a case where a foreign material such as a screw driver is inserted in place of the plug pin 91 so that the S like shape switch terminal 95 is excessively bent, the switch terminal 95 is plastically deformed, which may substantially result in a poor connection between the switch terminal 95 and the fixed terminal 94 after that.

Furthermore, a contact for a plug pin 96 in the S-shaped switch terminal 95 is opposed to a plug pin insertion hole 97 in the direction of insertion 92 of the plug pin 91. Accordingly, dust, plating residues, or the like entering from the plug pin insertion hole 97 may, in some cases, be attached to the contact for a plug pin 96. In the coaxial connector disclosed in the above-mentioned gazette, when the plug pin 91 is pressed thereinto, a contact area between the plug pin 91 and the contact for a plug pin 96 in the switch terminal 95 is not changed. When the dust is attached, as described above, therefore, the connection therebetween becomes poor. Consequently, the coaxial connector may not be satisfactorily examined.

An object of the present invention is to provide a thin coaxial connector with a switch which can be satisfactorily examined because it does not easily cause a poor connection between a switch terminal and a fixed terminal and is not easily affected by dust or the like.

SUMMARY OF THE INVENTION

In a preferred mode of the present invention, a coaxial connector with a switch comprises a housing for defining a terminal accommodation chamber opened through a plug pin insertion hole, and a fixed terminal and a switch terminal which are held by the housing. The switch terminal comprises a U-shaped section opened toward the plug pin insertion hole in the terminal accommodation chamber. The U-shaped section is elastically deformable in a direction crossing the direction of plug pin insertion. As the U-shaped section is deformed in the direction crossing the direction of plug pin insertion, the switch terminal is switched from a state in which it is brought into contact with the fixed terminal to a state in which the contact thereof with the fixed terminal is cut off.

In the above-mentioned mode, the U-shaped section in the switch terminal is deformed in the direction crossing the direction of plug pin insertion. Therefore, it is possible to thin the coaxial connector while ensuring the elastic deformation range of the switch terminal.

DESCRIPTION OF THE PREFERRED EMBODIMENTS

Figure 1:
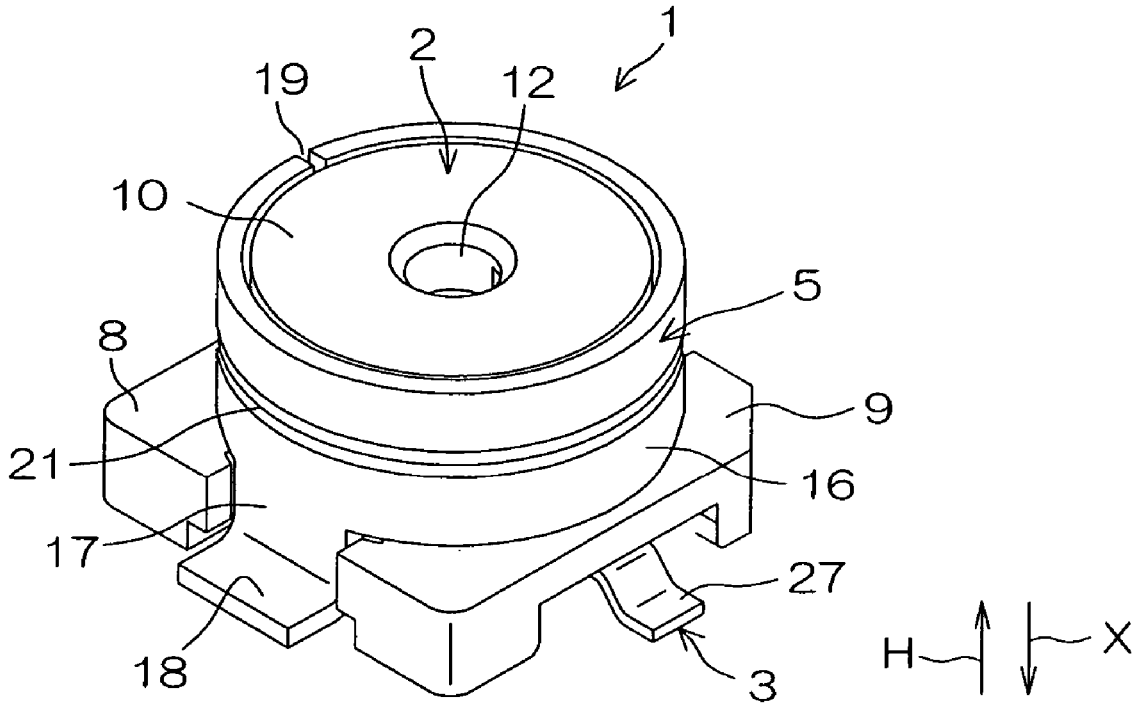
FIG. 1 is a perspective view of a coaxial connector with a switch according to an embodiment of the present invention.

An embodiment of the present invention will be described while referring to the accompanying drawings.

Referring to FIGS. 1 to 4, a coaxial connector with a switch 1 (hereinafter merely referred to as a connector 1)

according to an embodiment of the present invention comprises a housing 2 composed of an insulative synthetic resin, a fixed terminal 3 and a switch terminal 4 which are held in the housing 2, and a shell for electromagnetic shielding 5 composed of a conductive metal having a cylindrical shape, surrounding the housing 2.

Figure 11:
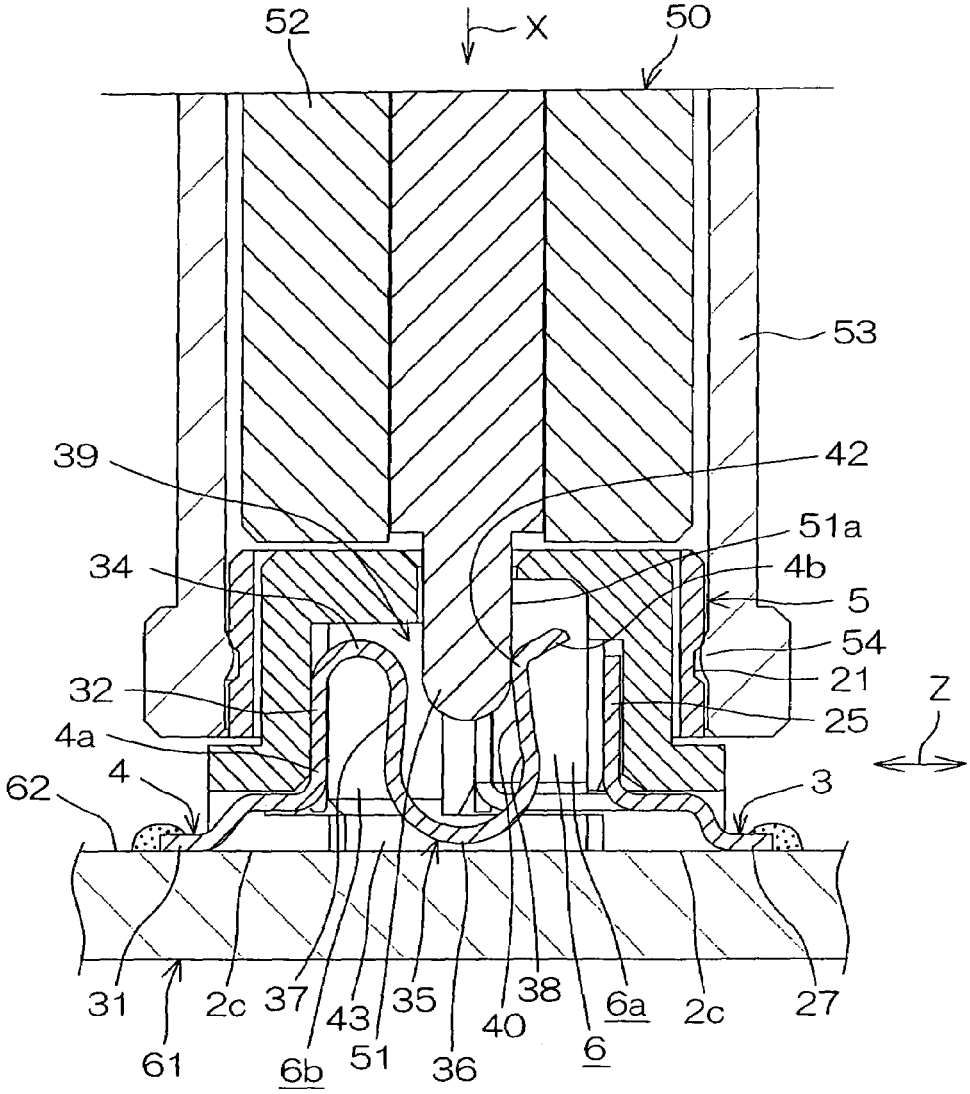
FIG. 11 is a schematic sectional view showing the coaxial connector with a switch fixed to a circuit board and an examination device for examining the coaxial connector.
Figure 12:
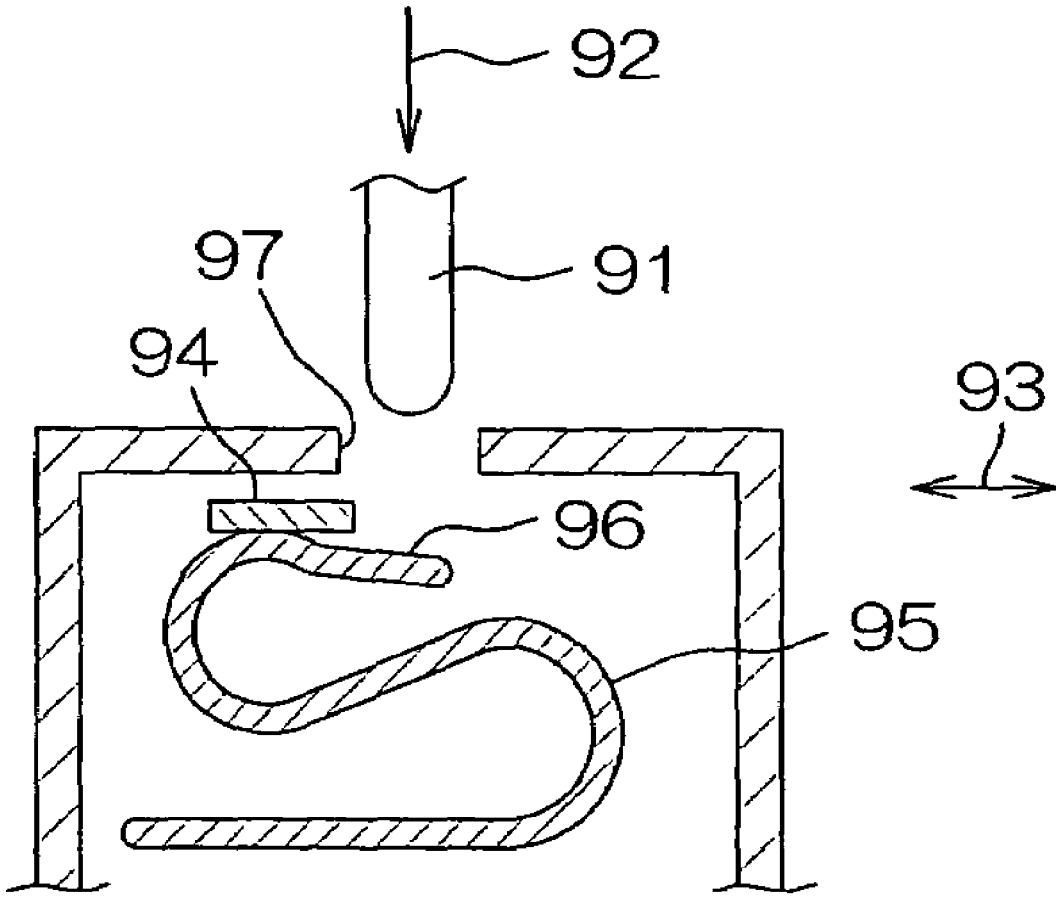
FIG. 12 PRIOR ART
FIG. 12 is a schematic sectional view showing the schematic configuration of a conventional coaxial connector with a switch.

The housing 2 comprises a cylinder 7 for defining a terminal accommodation chamber 6 (see FIG. 5) in its inner part, and a pair of bases 8 and 9 provided in an extended manner sideward from the bottom of the cylinder 7. The cylinder 7 comprises an upper surface 10 and a peripheral side wall 11. At the center of the upper surface 10, a plug pin insertion hole 12 for inserting a plug pin 51 in an examination device 50 as shown in FIG. 11 in a direction of insertion X (corresponding to a direction opposite to a direction along the height H of the housing 2) is formed. The terminal accommodation chamber 6 is opened outward through the plug pin insertion hole 12.

Figure 6:
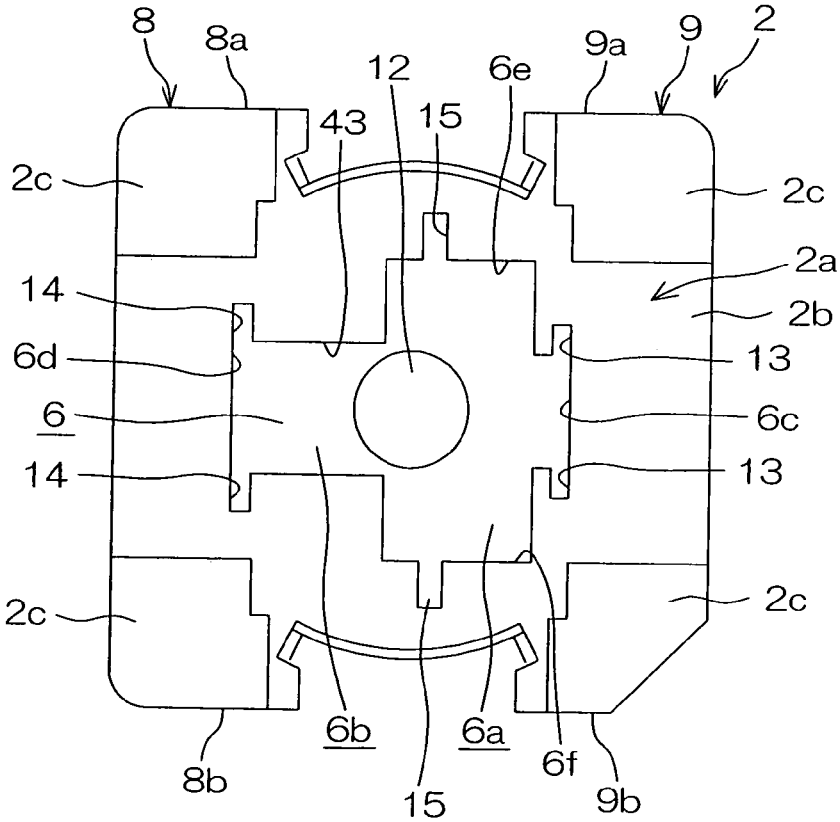
FIG. 6 is a bottom view of a housing.

Referring to FIG. 6, which is a bottom view of the housing 2, the terminal accommodation chamber 6 is opened by providing an opening 43 having a T shape turned sideways at the center of a bottom surface 2*a* of the housing 2. Further, a recess 2*b* is provided so as to surround the terminal accommodation chamber 6, leaving four corners of the bottom surface 2*a* of the housing 2. A mounting surface 2*c* higher by one stage than the recess 2*b* is provided at each of the four corners of the bottom surface 2*a* (corresponding to the bottoms at ends 8*a* and 9*a* of the bases 8 and 9). The mounting surface 2*c* is made parallel to a surface 62 of a circuit board 61 to which the connector 1 is fixed, as shown in FIG. 11.

The terminal accommodation chamber 6 has a wide first accommodation chamber 6*a* for mainly accommodating a portion of the fixed terminal 3 and a narrow second accommodation chamber 6*b* for mainly accommodating a portion of the switch terminal 4.

There are provided a pair of first engagement grooves 13 and a pair of second engagement grooves 14 which respectively extend along wall surfaces 6*c* and 6*d*, opposed to each other, of the first and second accommodation chambers 6*a* and 6*b*. Further, a pair of third engagement grooves 15 opposed to each other with the plug pin insertion hole 12 interposed therebetween is provided on wall surfaces 6*e* and 6*f*, opposed to each other, of a wide portion of the first accommodation chamber 6*a*. The first, second and third engagement grooves 13, 14, and 15 extend in the direction of the height H of the housing 2 (a direction perpendicular to paper in FIG. 6), which is the direction of insertion X of the plug pin 51. The first and third engagement grooves 13 and 15 correspond to the fixed terminal 3, and the second engagement groove 14 corresponds to the switch terminal 4.

Figure 2:
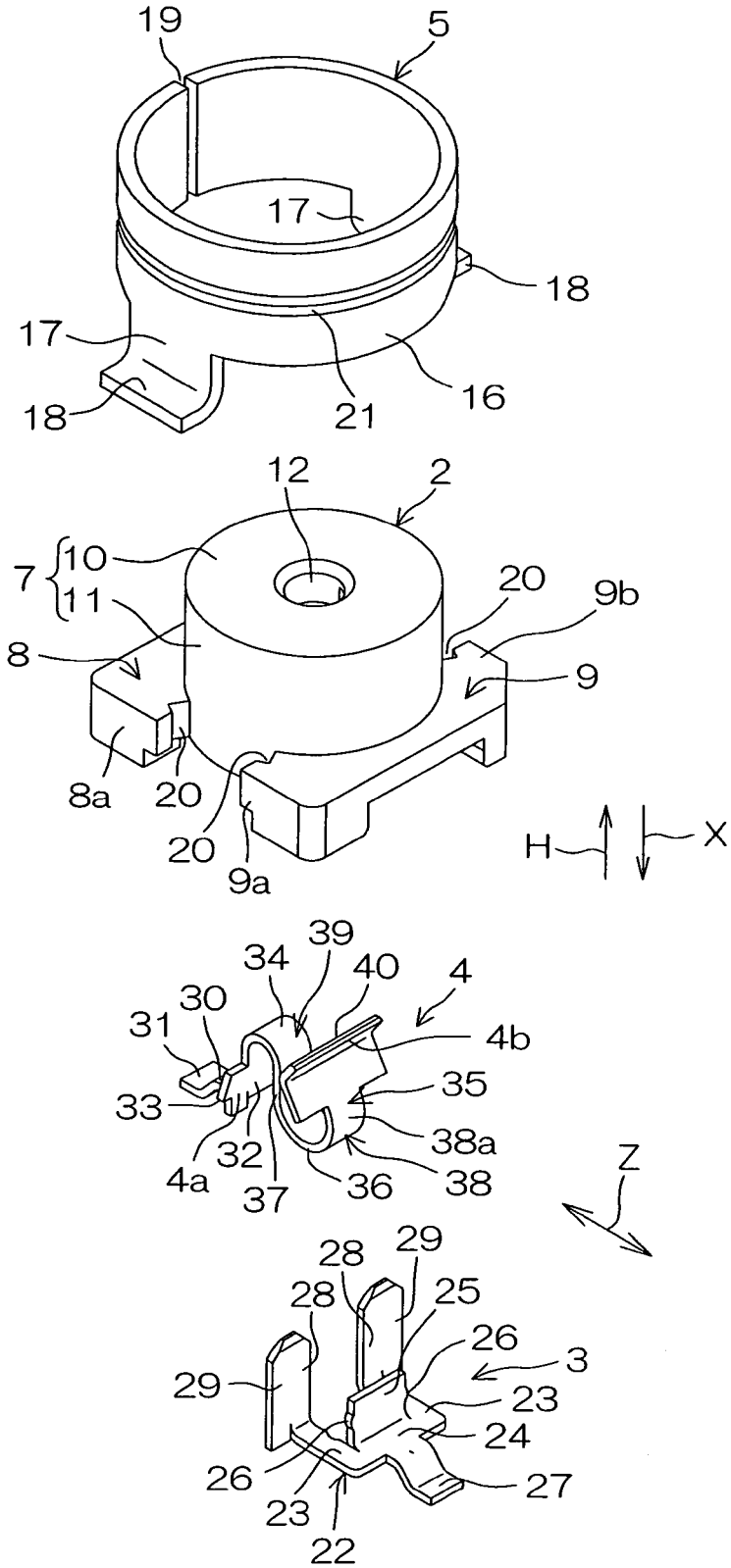
FIG. 2 is an exploded perspective view of the coaxial connector with a switch.

Mainly referring to FIG. 2, the above-mentioned shell 5 comprises a cylinder 16 fitted in the outer periphery of the cylinder 7 in the housing 2, and a pair of extended pieces 17 provided at symmetrical positions with the center of the cylinder 16 interposed therebetween. Each of the extended pieces 17 is provided in an extended manner in the axial direction of the cylinder 16 from a lower edge of the cylinder 16. A front end of each of the extended pieces 17 is bent outward to form legs 18. Each of the legs 18 constitutes a lead connected to a ground circuit on the surface 62 of the circuit board 61 to which the connector 1 is fixed by soldering, for example, as shown in FIG. 11.

Figure 3:
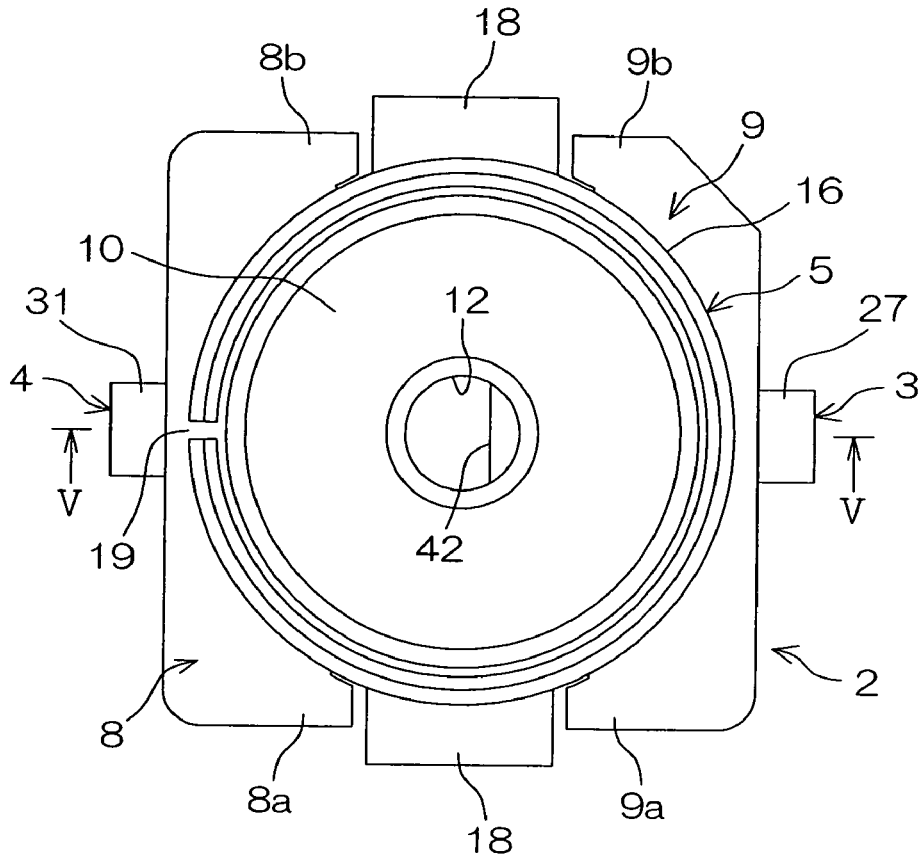
FIG. 3 is a plan view of the coaxial connector with a switch.

Referring to FIGS. 2 and 3, the cylinder 16 in the shell 5 is provided with a slit 19 extending in the axial direction at a central position between the extended pieces 17 in the circumferential direction so that the diameter thereof can be elastically enlarged. The cylinder 16 in the shell 5 is fitted in the cylinder 7 in the housing 2 in a state in which the diameter thereof is made slightly larger than that in a free state by elastic deformation, and is held in the cylinder 7 in the housing 2 by its own elastic repulsive force.

Each of the extended pieces 17 in the shell 5 is introduced between the ends 8*a* and 9*a*, opposed to each other, of the pair of bases 8 and 9 in the housing 2 in a state in which the cylinder 16 in the shell 5 is fitted in the cylinder 7 in the housing 2. Referring to FIG. 2, the ends 8*a* and 9*a* of the bases 8 and 9 respectively have engagement grooves 20 engaged with side edges of the corresponding extended pieces 17.

Figure 4:
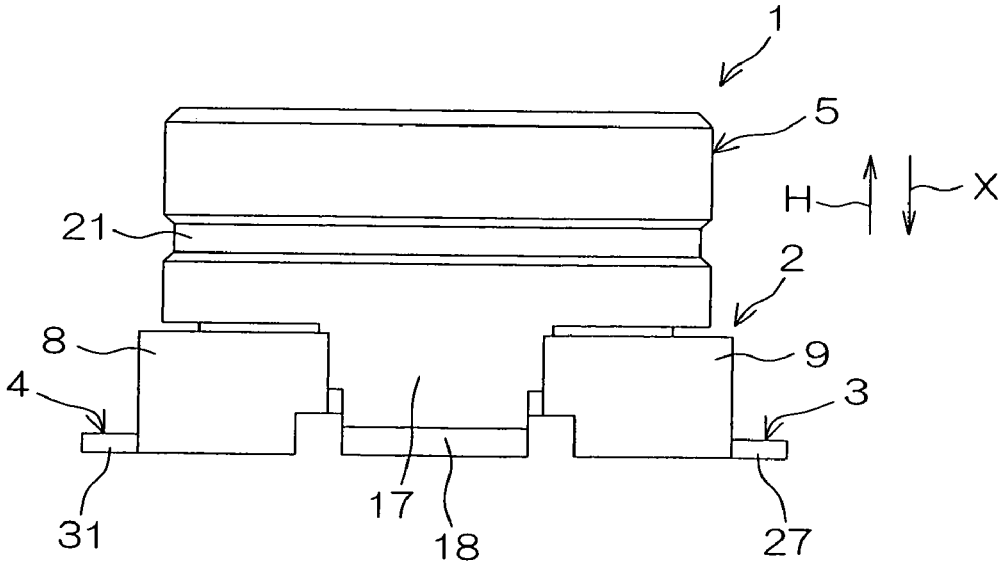
FIG. 4 is a front view of the coaxial connector with a switch.

Referring now to FIGS. 2 and 4, an outer peripheral groove 21 is provided in the middle of the cylinder 16 in the shell 5. The outer peripheral groove 21 is used for engaging an annular projection 54 in the inner periphery of a cylinder 53 for positioning which covers a main body 52 of the examination device 50 as shown in FIG. 11.

Figure 5:
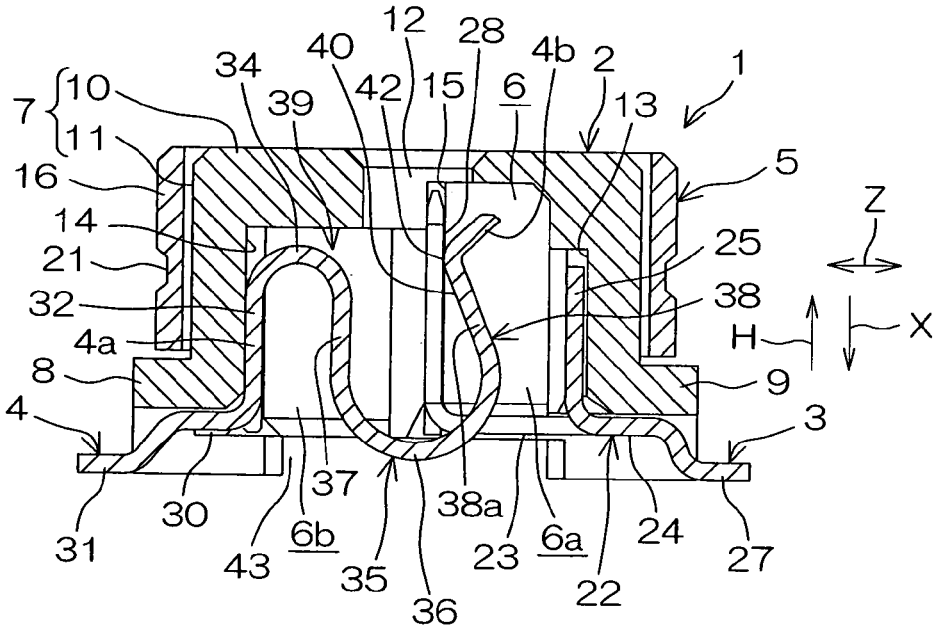
FIG. 5 is a cross-sectional view taken along a line V—V shown in FIG. 3.
Figure 7:
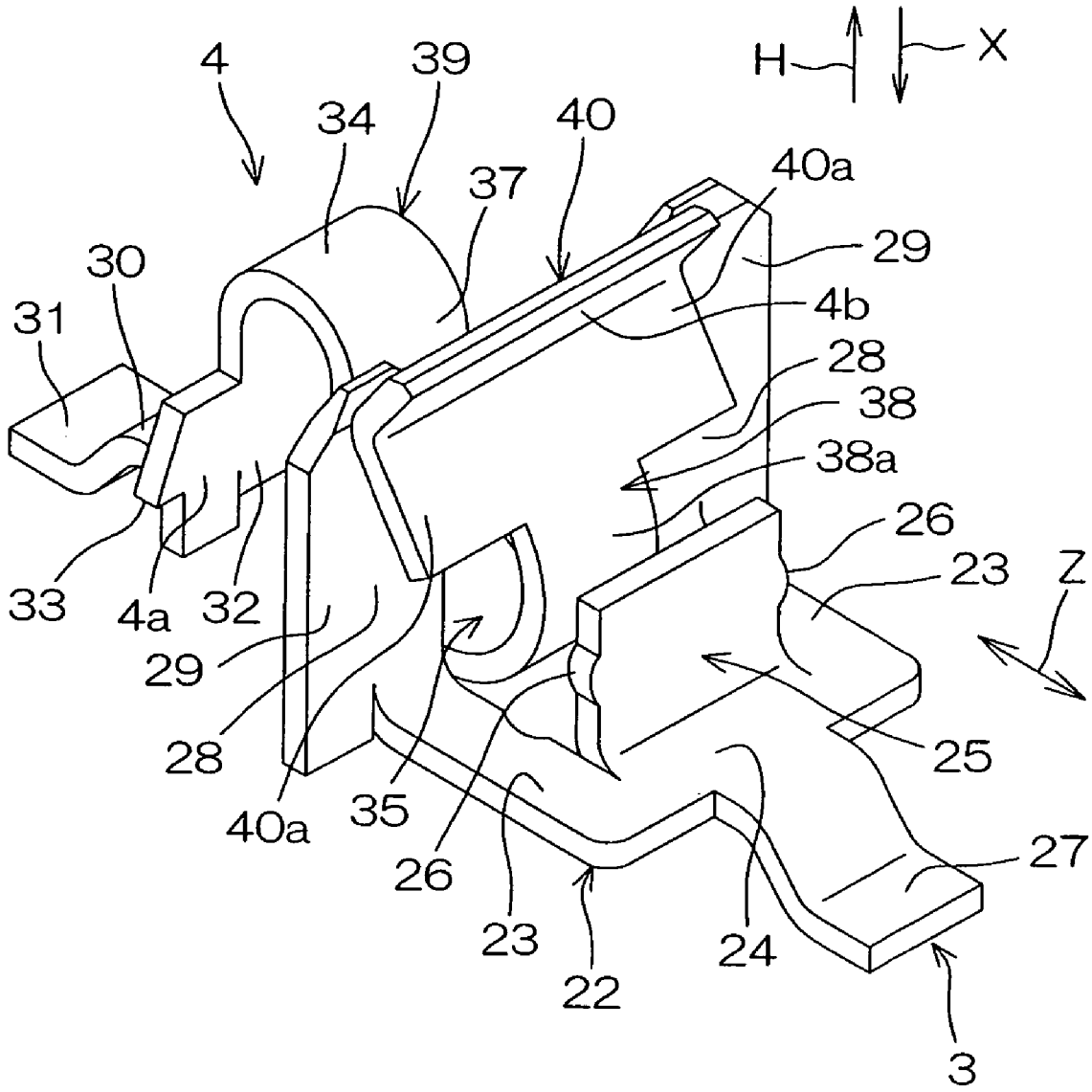
FIG. 7 is a perspective view of a fixed terminal and a switch terminal in a state in which they are combined with each other.
Figure 8:
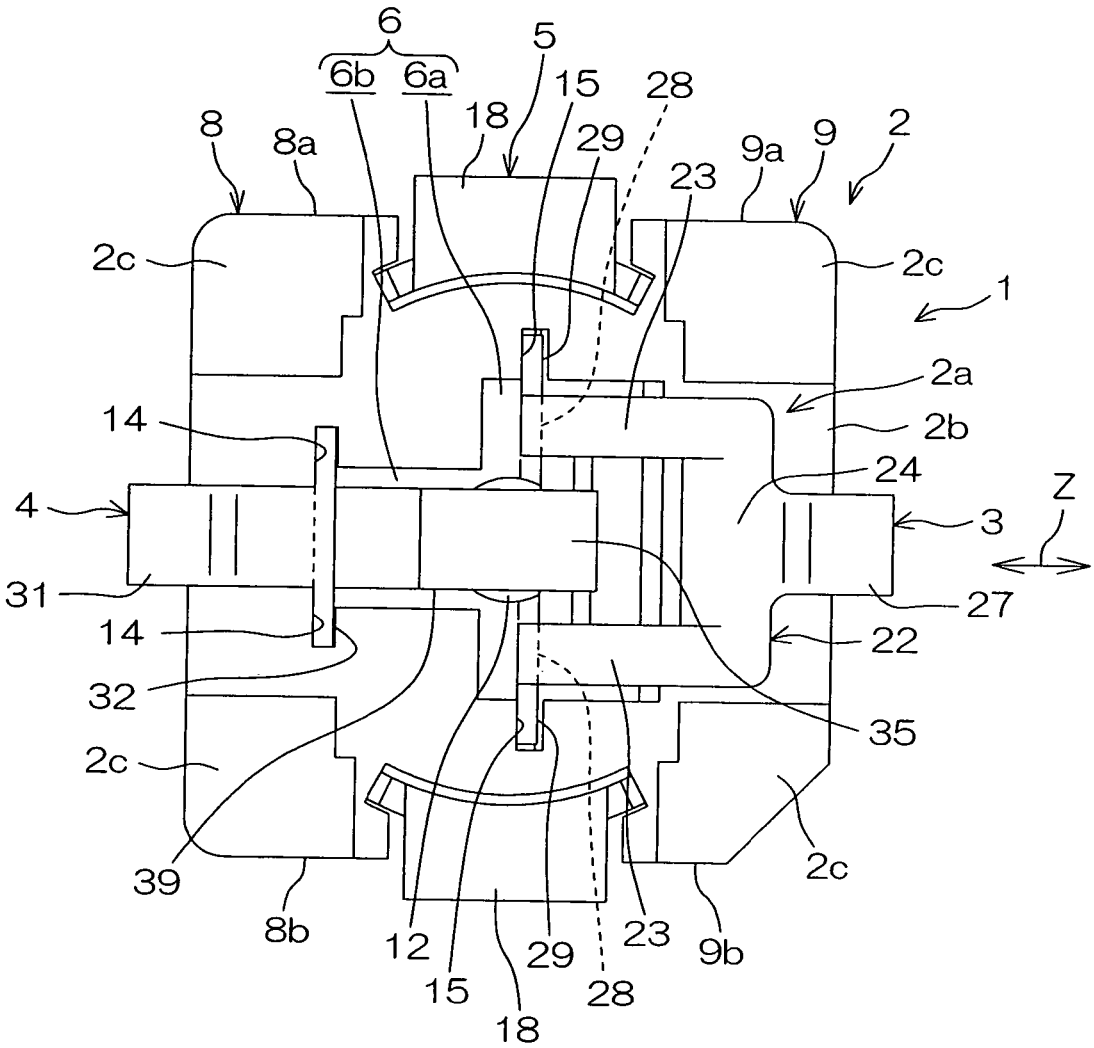
FIG. 8 is a bottom view of the coaxial connector with a switch.

Referring to FIGS. 2, 5, and 7, the fixed terminal 3 comprises a terminal main body 22 in a ⊐shape. The terminal main body 22 is arranged parallel to the recess 2*b* on a bottom surface 2*a* of the housing 2, as shown in FIG. 5. Referring to FIGS. 2 and 5, the terminal main body 22 comprises a pair of pieces 23 extending parallel to each other, and a connecting piece 24 connecting respective one ends of the pieces 23.

There is provided a fixed piece 25 bent at substantially right angles from one side edge of a connecting piece 24 and extending in the direction along the height H of the housing 2. Engagement projections 26 are respectively formed at a pair of side edges, opposed to each other, of the fixed piece 25. The fixed piece 25 is locked to the first engagement groove 13 (see FIG. 5) by the function of the engagement projection 26. A lead 27 having a substantially L shape is provided in an extended manner from the other side edge of the connecting piece 24, and is drawn out of the housing 2 after passing under the bottom of the base 9.

There is provided a plate-shaped fixed contact 28 bent at substantially right angles from a front end of each of the pieces 23 in the terminal main body 22 and extending in the direction along the height H of the housing 2. That is, the fixed contact 28 is arranged in the direction of insertion X of the plug pin 51. Each of the fixed contacts 28 has an engagement edge 29 provided in an extended manner on its outer side part, and each of the engagement edges 29 is engaged with the corresponding third engagement groove 15 inside the terminal accommodation chamber 6, thereby regulating the displacement of the corresponding fixed contact 28.

Referring to FIGS. 2, 5, and 7, the switch terminal 4 comprises a fixed end 4*a* and a free end 4*b*. The switch terminal 4 comprises a plate-shaped terminal main body 30 arranged so as to be parallel to the recess 2*b* on the bottom surface 2*a* of the housing 2. A lead 31 having a substantially L shape is provided in an extended manner from one side edge of the terminal main body 30, and is drawn out of the housing 2 after passing under the bottom of the base 8.

There is provided a fixed piece 32 bent at substantially right angles from the other side edge of the terminal main body 30 and extending in the direction along the height H of the housing 2 to provide the fixed edge 4. Engagement projections 33 are respectively formed at a pair of side parts, opposed to each other, of the fixed piece 32. The fixed piece 32 is locked to the second engagement groove 14 by the function of the engagement projections 33.

The fixed piece 32 comprises a U-shaped section 35 having a U shape (or an inverted Ω shape) opened upward through a first elastic bending section 34 in an upward convex shape and more specifically, toward the plug pin insertion hole 12. The U-shaped section 35 is elastically deformable in a direction Z crossing the direction of plug pin insertion X. As the U-shaped section 35 is deformed in the above-mentioned direction Z, the switch terminal 4 is switched from a state in which it is brought into contact with the fixed terminal 3 to a state in which the contact thereof with the fixed terminal 3 is cut off.

The U-shaped section 35 comprises first and second pieces 37 and 38 connecting with each other through a second elastic bending section 36 and extending substantially parallel to the direction along the height H of the housing 2. The fixed piece 32 thus connects with the first piece 37 in the U-shaped section 35 through the first elastic bending section 34 so that a section 39 having a substantially S shape turned sideways in cooperation with the U-shaped section 35 is formed. Consequently, the switch terminal 4 has the two elastic bending sections 34 and 36, thereby making it possible to ensure a sufficient amount of elastic deformation.

Referring to FIGS. 5 to 7, the second piece 38 in the U-shaped section 35 comprises a first section 38*a* inserted between the fixed contacts 28, and a second section 40 arranged closer to the free end 4*b* of the switch terminal 4 than the first section 38*a*.

The width of the second section 40 in the second piece 37 is larger than the width of the first section 38*a*, and the first section 38*a* and the second section 40 in the second piece 37 form a T shape. The second section 40 in the second piece 37 protrudes toward the back of the fixed contact 28, and the width of the second section 40 is larger than the width of a clearance between the fixed contacts 28.

Figure 9:
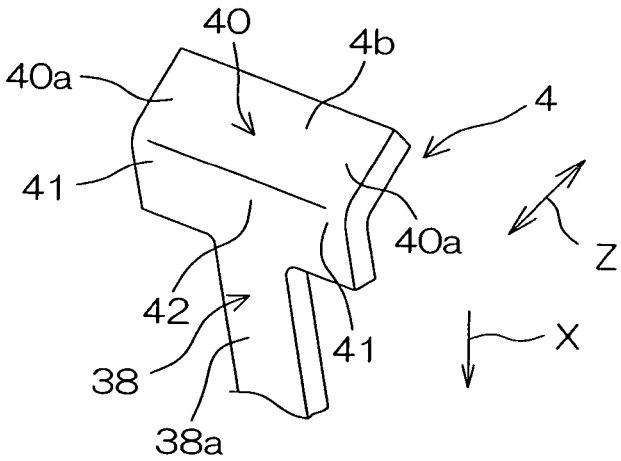
FIG. 9 is a schematic perspective view showing a principal part of a second piece of a switch terminal.
Figure 10:
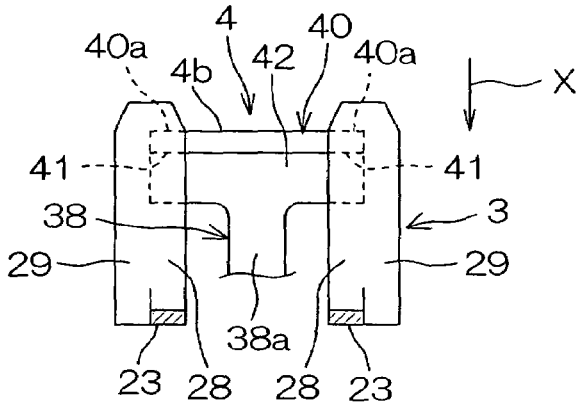
FIG. 10 is a schematic view showing a principle part of a fixed terminal and a switch terminal, and is a diagram showing the switch terminal combined with the fixed terminal as viewed from the side of the fixed terminal.

The second section 40 comprises a pair of ends 40*a* opposed to each other, and each of the ends 40*a* of the second section 40 is provided with a corresponding first movable contact 41. As shown in FIGS. 9 and 10, the first movable contact 41 provided at each of the pair of ends 40*a* of the second section 40 in the second piece 38 is brought into elastic contact with the corresponding fixed contact 28 from the side.

In the second section 40 in the second piece 38, a second movable contact 42 for coming into contact with the plug pin 51 is provided in an intermediate section 44 between the first movable contacts 41. The second movable contact 42 is at a position facing the plug pin insertion hole 12, as shown in FIG. 3, except for the time of examination when the plug pin 51 is inserted into the plug pin insertion hole 12 in the housing 2.

The second section 40 in the second piece 38 is formed in a mountain-shaped section projecting toward the first piece 37, that is, toward the fixed contact 28.

As shown in FIG. 11, when the plug pin 51 in the examination device 50 is inserted into the plug pin insertion hole 12 at the time of examination, the second movable contact 42 at the center of the second section 40 in the second piece 38 in the switch terminal 4 is pressed sideward and is displaced by the plug pin 51, so that the second movable contact 42 is brought into elastic contact with the plug pin 51, and the contact between the first movable contacts 41 at both ends of the second section 40 in the second piece 38 and the fixed contacts 28 in the fixed terminal 3 is cut off as the above-mentioned displacement occurs.

According to the present embodiment, the first movable contact 41 is generally brought into elastic contact with the fixed contact 28 by the spring properties of the switch terminal 4 itself curved in a U shape. When the plug pin 51 is inserted into the plug pin insertion hole 12, and the second movable contact 42 is brought into contact with a side part 51*a* of the plug pin 51, the switch terminal 4 is electrically connected to the plug pin 51, the second piece 38 in the U-shaped section 35 in the switch terminal 4 is displaced in a direction crossing the direction of insertion X of the plug pin 51 (sideward), and the contact between each of the first movable contacts 41 and the corresponding fixed contacts 28 is cut off.

When the plug pin 51 is extracted from the plug pin insertion hole 12, the switch terminal 4 is restored to the original position again by its own elasticity, and the first movable contact 41 is brought into elastic contact with the fixed contact 28.

The switch terminal 4 is displaced in the direction crossing the direction of insertion X of the plug pin 51. Accordingly, it is possible to thin the coaxial connector 1 while ensuring the elastic deformation range of the switch terminal 4.

Furthermore, the fixed terminal 3 comprises the pair of fixed contacts 28, and the second piece 38 in the U-shaped section 35 in the switch terminal 4 comprises the narrow first section 38*a* inserted between the pair of fixed contacts 28 and the wide second section 40 closer to the front end than the first section 38*a*. The second section 40 has the pair of first movable contacts 41 respectively corresponding to the fixed contacts 28 provided at both its ends, and has the second movable contact 42 provided between the pair of first movable contacts 41. Consequently, a pair of the switch terminal 4 is inserted into the fixed terminal 3, so that the switch terminal is combined with the fixed terminal 3. Accordingly, it is possible to ensure a sufficient amount of elastic deformation of the switch terminal 4 while ensuring space saving. Since the fixed terminal 3 and the switch terminal 4 ensure the contact between the corresponding contacts 28 and 41, the reliability of the coaxial connector 1 is high.

Since the second movable contact 42 is rubbed (that is, wiped) by the plug pin 51 at the time of insertion, the coaxial connector 1 can be reliably examined without being affected by dust or the like.

Furthermore, even if a foreign material such as a screw driver is significantly deeply inserted into the plug pin insertion hole 12, the switch terminal 4 is not plastically deformed. Thereafter, no problem occurs in the later connection between the first movable contact 41 in the switch terminal 4 and the fixed contact 28 in the fixed terminal 3.

Moreover, the switch terminal 4 is provided with a section 39 having a substantially S shape turned sideways, including the U-shaped section 35, and comprises the two elastic bending sections 34 and 36. Therefore, it is possible to ensure a sufficient amount of elastic deformation of the switch terminal 4 while achieving space saving.

Furthermore, on the bottom surface 2*a* of the housing 2, the terminal accommodation chamber 6 for accommodating the fixed terminal 3 and the switch terminal 4, together with the first, second and third engagement grooves 13, 14, and 15, are opened through the opening 43, and the terminal main bodies 22 and 30 and the leads 27 and 31 in the fixed terminal 3 and the switch terminal 4 respectively are accommodated in the recess 2*b* on the bottom surface 2*a*. Therefore, the fixed terminal 3 and the switch terminal 4 can be easily incorporated from the same direction through the opening 43, thereby making it easy to assemble the coaxial connector 1.

While the invention has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

The present application corresponds to an application NO. 2003-110735 filed with the Japan Patent Office on Apr. 15, 2003, the disclosure of which is hereinto incorporated by reference.

What is claimed is:

1. A coaxial connector with a switch, comprising:

a housing for defining a terminal accommodation chamber opened through a plug pin insertion hole; and a fixed terminal and a switch terminal which are held by the housing;

the switch terminal configured as a turned-sideways substantially S-shape having a first elastic bend section, a second elastic bend section, a first piece, a second piece and a movable contact, the first piece interconnecting the first and second bend sections, the second piece interconnecting the second bend section and the movable contact, the first piece, the second bend section and the second piece defining a U-shaped section opened toward the plug pin insertion hole in the terminal accommodation chamber, the U-shaped section being elastically deformable and the second bend movable as the U-shaped section elastically deforms in a direction crossing a direction of plug pin insertion;

the switch terminal being switched from a fixed terminal contact state in which the second piece contacts the fixed terminal to a fixed terminal cut-off state in which the contact thereof with the fixed terminal is cut off as the U-shaped section is deformed and the second piece is moved away from the first piece in the direction crossing the direction of plug pin insertion, the second bend section intersecting the direction of plug pin insertion.

2. The coaxial connector with a switch according to claim 1, wherein the fixed terminal comprises at least one fixed contact arranged substantially parallel to the direction of plug pin insertion in the terminal accommodation chamber, wherein the U-shaped section in the switch terminal comprises first and second movable contacts, wherein the first movable contact can be brought into contact with the fixed contact in the fixed terminal from a side, and the second movable contact can be brought into contact with a side part of a plug pin inserted from the plug pin insertion hole, and wherein the second movable contact is brought into contact with the plug pin, and the contact between the first movable contact and the fixed contact is cut off when the plug pin is inserted from the plug pin insertion hole.

3. The coaxial connector with a switch according to claim 2, wherein the first movable contact is displaced sideward as the plug pin displaces the second movable contact sideward when the plug pin is inserted from the plug pin insertion hole, so that the first movable contact separates from the fixed contact.

4. The coaxial connector with a switch according to claim 1, wherein the U-shaped section comprises first and second pieces connecting with each other through an elastic bending section and extending substantially parallel to the direction of plug pin insertion.

5. The coaxial connector with a switch according to claim 4, wherein the switch terminal comprises a fixed end and a free end, wherein the first piece and the second piece in the U-shaped section respectively connect with the fixed end and the free end, and wherein the first and second movable contacts are provided in the second piece in the U-shaped section.

6. The coaxial connector with a switch according to claim 1, wherein the switch terminal further comprises a section having a substantially S shape turned sideways.

7. The coaxial connector with a switch according to claim 6, wherein the switch terminal further comprises a fixed piece connecting with an end of the first piece in the U-shaped section through the elastic bending section, to form the section having a substantially S shape turned sideways in cooperation with the U-shaped section.

8. The coaxial connector with a switch according to claim 1, wherein the terminal accommodation chamber has an opening into which the fixed terminal and the switch terminal can be incorporated from the same direction.

9. The coaxial connector with a switch according to claim 2, wherein the at least one fixed contact is two fixed contacts and respective ones of the first and second movable contacts correspond to respective ones of the two fixed contacts.

10. The coaxial connector with a switch according to claim 9, wherein the second piece in the U-shaped section in the switch terminal comprises a first section inserted between the two fixed contacts and a second section arranged closer to the free end in the switch terminal than the first section.

11. The coaxial connector with a switch according to claim 10, wherein a width of the second section in the second piece is larger than a width of the first section in the second piece, and wherein the first section and the second section in the second piece forms a T shape.

12. The coaxial connector with a switch according to claim 10, wherein a width of the second section in the second piece is larger than a width of a clearance between the fixed contacts.

13. The coaxial connector with a switch according to claim 10, wherein the second section comprises a pair of ends opposed to each other, and wherein the first movable contacts are provided at the ends in the second section respectively.

14. The coaxial connector with a switch according to claim 10, wherein the second section comprises an intermediate section between a pair of the ends, and wherein the second movable contact is provided in the intermediate section in the second section.

15. The coaxial connector with a switch according to claim 10, wherein the second section in the second piece includes a mountain-shaped section projecting toward the fixed contact.

* * * * *